US007694671B2

(12) United States Patent
Lee

(10) Patent No.: US 7,694,671 B2
(45) Date of Patent: Apr. 13, 2010

(54) FLAME FOCUSING RING FOR STOVETOP GAS BURNER AND UNIVERSAL WOK SUPPORT

(76) Inventor: Glen Lee, 301 79th St., Apt. C-1, North Bergen, NJ (US) 07047

( * ) Notice: Subject to any disclaimer, the term of this patent is extended or adjusted under 35 U.S.C. 154(b) by 0 days.

(21) Appl. No.: 12/184,065

(22) Filed: Jul. 31, 2008

(65) Prior Publication Data

US 2010/0024796 A1 Feb. 4, 2010

(51) Int. Cl.
*F24C 3/08* (2006.01)

(52) U.S. Cl. ..... 126/214 D; 126/9 R; 126/39 K

(58) Field of Classification Search ..... 126/1, 126/1 R, 9, 9 B, 24, 39 B, 39 E, 39 K, 39 M, 126/40, 43–49, 152 B, 153, 154, 211, 214, 126/214 D, 215, 216, 400, 9 R, 39 R; 7/109; 219/385, 386, 390, 443.1, 451.1, 452.11, 219/455.12, 456.1, 481, 521, 534, 535; *F24C 3/08, F24C 15/10, 1/16*

See application file for complete search history.

(56) References Cited

U.S. PATENT DOCUMENTS

| | | | | | |
|---|---|---|---|---|---|
| 561,507 | A * | 6/1896 | Fenton | 126/215 |
| 698,507 | A * | 4/1902 | Jeha | 126/215 |
| 834,733 | A * | 10/1906 | Jeha | 126/215 |
| 881,199 | A * | 3/1908 | Palmer | 126/215 |
| 936,482 | A * | 10/1909 | Seeley | 126/43 |
| 983,413 | A * | 2/1911 | Swafford | 126/214 D |
| 1,072,115 | A * | 9/1913 | Harmon | 126/39 R |
| 1,131,226 | A * | 3/1915 | Frank | 126/215 |
| 1,142,603 | A * | 6/1915 | Moellendick | 126/214 R |
| 1,239,150 | A * | 9/1917 | Williams et al. | 126/215 |
| 1,346,761 | A * | 7/1920 | Moore | 431/356 |
| 1,414,146 | A * | 4/1922 | Moellendick | 126/214 D |
| 1,431,696 | A * | 10/1922 | Shankland | 126/215 |
| 1,471,788 | A * | 10/1923 | Gardner | 126/215 |
| 1,546,919 | A * | 7/1925 | Dore | 126/214 D |

(Continued)

FOREIGN PATENT DOCUMENTS

DE 4142683 A1 * 6/1993

(Continued)

OTHER PUBLICATIONS

Amazon.com: http://www.amazon.com/Wok-Ring/product-reviews/B00012F3X6/ref=dp_top_cm_cr_acr_txt?ie=UTF8&showViewpoints=1; p. 2, 3; (c) Amazon.com Inc.*

*Primary Examiner*—Steven B McAllister
*Assistant Examiner*—Daniel E Namay
(74) *Attorney, Agent, or Firm*—Donald W. Meeker

(57) ABSTRACT

A flame concentrating ring with an inwardly curved upper wall portion and air inlet vents at its base for encircling a gas burner and directing the flames upwardly and inwardly to focus on the bottom center of a wok A wok support ring straddles a stovetop grate. The wok support ring comprises a truncated conical base having a narrow opening at the top for supporting the bottom of a wok, a wide opening at the bottom thereof which rests on a stove grate, and a plurality of customizable break-away tabs of which a user breaks a plurality out to form stove grate-engaging notches The wok support ring incorporates a plurality of ball bearings to cradle bottom of wok to allow freedom of movement and manipulating of wok.

9 Claims, 4 Drawing Sheets

U.S. PATENT DOCUMENTS 1,592,729 A * 7/1926 Feist ..... 126/214 D
1,692,000 A * 11/1928 Steffens ..... 126/214 D
1,772,407 A * 8/1930 Wilhelm ..... 431/350
1,881,606 A * 10/1932 Humphreville ..... 126/214 D
2,327,807 A * 8/1943 Lotter ..... 126/39 H
2,541,265 A * 2/1951 McGregor ..... 126/215
D225,433 S * 12/1972 Rosenlund ..... D7/360
3,835,832 A * 9/1974 Welcker ..... 126/215
4,006,676 A * 2/1977 Adamis ..... 99/422
D250,931 S * 1/1979 Pierce ..... D7/408
4,337,752 A * 7/1982 Leounes ..... 126/215
4,448,186 A * 5/1984 Smith ..... 126/215
4,607,613 A * 8/1986 Toldi ..... 126/215
D317,549 S * 6/1991 Stadelmaier ..... D7/360
5,158,067 A * 10/1992 Dutro et al. ..... 126/39 R
5,241,900 A * 9/1993 Piane, Sr. ..... 99/422
5,315,983 A * 5/1994 Law ..... 126/216
5,345,062 A * 9/1994 Maudal ..... 219/432
D364,534 S * 11/1995 Brown et al. ..... D7/407
D376,066 S * 12/1996 Taniguchi et al. ..... D7/339
5,775,316 A * 7/1998 Jones ..... 126/41 R
5,791,333 A * 8/1998 Bennett ..... 126/214 D
6,093,018 A * 7/2000 Avshalumov ..... 431/352
D438,422 S * 3/2001 Choi ..... D7/360
6,718,967 B2 * 4/2004 Luther ..... 126/40
D525,479 S * 7/2006 Olsen et al. ..... D7/360
D545,124 S * 6/2007 Hawkins et al. ..... D7/409
2002/0162923 A1 * 11/2002 Geddes ..... 248/176.1
2003/0121512 A1 * 7/2003 Luther ..... 126/41 R
2007/0039603 A1 * 2/2007 Lindsly et al. ..... 126/38
2008/0302353 A1 * 12/2008 Sun ..... 126/39 K
2009/0078247 A1 * 3/2009 Sun ..... 126/39 R

FOREIGN PATENT DOCUMENTS

WO WO 9312702 A1 * 7/1993

* cited by examiner

FLAME FOCUSING RING FOR STOVETOP GAS BURNER AND UNIVERSAL WOK SUPPORT

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to gas burner attachments and particularly to a wok support ring which straddles a stovetop grate and a flame concentrating ring with an inwardly curved upper wall portion and air inlet vents at its base for encircling a gas burner and directing the flames upwardly and inwardly to the focus on the bottom center of a wok.

2. Description of Related Art Including Information Disclosed Under 37 CFR 1.97 and 1.98

The development of the traditional wok by the Chinese over 2,500 years ago was necessary from the tough living conditions in China. Scarce supply of firewood forced the frugal Chinese to devise the present day methods of flash-flame cooking or better known as stir-fry.

The stir-flying technique involves the use of a Chinese wok, which usually requires cooking of vegetables and meats for very short time periods at high heat. In a typical stir-fry recipe, the cooking time is three to five minutes, or less. The health benefits of short-time cooking with minimal use of fats are substantial. Less fat is absorbed by the food being cooked in a wok than with western methods and resulting fat intake by the consumer is at a minimum. In addition to the health benefits, the flavor of the food, particularly vegetables, is substantially retained by the high heat searing of the food surfaces.

Chinese restaurants can attain these high temperatures by using commercial burners that reach over 200,000 BTU's (British Thermal Units). The typical American gas stove burner outputs an average 7,000 to 15,000 BTU's maximum. The commercial burners are able to bring the surface temperature of the wok to over 700 degrees F. to impart what the Chinese experts says is the elusive "Wok Hay". "Hay", the Cantonese Chinese pronunciation, or "chi" or "qi", the Mandarin Chinese pronunciations (the ones most familiar to the non-Chinese reader), is breath—the Chinese concept of vital energy that flows through the body. Chinese chefs stress Wok Hay must be achieved on the surface of the wok as the primary directive, this is not an issue for Chinese restaurants.

For stovetop cooking on a gas jet home stove, Wok Hay is quite elusive because of the insufficient amount of BTU's generated by the average domestic gas stove. This has given rise to a number of innovative wok designs in addition to the traditional cast-iron or stamped carbon steel woks that have entered the market. Today's Asian woks are manufactured in stainless steel, flat bottom, layered-steel/aluminum/steel, aluminum Teflon coated and electric/Teflon bottom. These types of woks have lured cooks away in the past, however, many devotees are returning to the faithful old cast iron or stamped carbon steel wok, because they respond most readily to changes in heat. Their thin gauge allows less time to heat up in preparation for cooking. Most commercially available Asian woks address certain aspects; heating, convenience and utility, however, they all are band-aids and miss their mark on the biggest issue in wok cooking: hi-temperature heat or Wok Hay.

Present day conventional gas stove burners are designed to take on all types of currently mass produced cookware. Practically all cookware is flat bottomed in nature. The typical western style stove burner emits a flame that fans outwardly as a pot or pan is placed on it. This design is most effective because it takes advantage of the entire flat surface area of the cookware.

In the case of the Asian wok, it's the opposite. The wok's unique round bottom causes the flame from a typical stovetop gas jet to mushroom out to its edges. This is an inherent design flaw against the wok. The wok and the conventional stovetop jet burner are not a compatible match.

One of the main problems with the use of the wok in Western kitchens is that it does not adapt well on electric and gas ranges. The wok was developed for use by placing it directly on rings with a wide based fire built underneath. However, the cooking surfaces utilized, particularly in the west, are typically flat for delivering heat to flat bottomed cooking vessels such as frying pans or sauce pans. The round dome surface of the wok does not adapt well to cooking on modern electric and gas ranges. Various methods have been utilized in attempts to overcome this problem.

One method involves modifying the structure of the wok itself. The production of flat bottomed woks for resting in a stable manner on a flat range top, has been done either by making the wok wall a uniform thickness and having both inside and outside have a flat bottom, in which case the wok is a little more than a high sided frying pan with all its inherent disadvantages, or by building the outside of the wok up only to leave a spherical cooking surface with a flat exterior surface. The disadvantage of this method is the cooking technique in spatula manipulation, i.e., movement of a metal spatula from a round surface to a flat plane. This can be discerning to those more accustomed to round bottomed woks. Flat bottomed woks do not permit the sweeping, surface-scooping motion of the round-edged spatulas used in wok cooking; where rapid, fluid motions are essential for effective stir-frying; and, flat bottomed woks do not permit the user to rock the wok smoothly over the heating surface in order to efficiently spread other ingredients to the food being cooked in the wok while keeping the wok in full contact with the heating surface. The other disadvantage of this method is that the weight and mass of the wok is increased.

Another modification to the wok has been the use of electric woks wherein the heating elements are arrayed in a partially spherical design at the bottom of the wok to provide even heat distribution. These woks are typically quite expensive and have the same disadvantages as the flat bottomed wok's unwieldiness. Their heat control thermostats are not sensitive enough for the quick temperature changes stir-frying demands. Another disadvantage to electric woks is that most of them are Teflon coated, which give rise of potential health issue associated with the inhaling of toxic fumes when the surface temperature exceeds 450 degrees F.

Those who wish to attain the advantage of cooking in a traditional thin walled wok have been forced either to abandon the use of modern ranges or else to utilize some form of interface adapter between the range and the wok. The alternate heating methods are less than desirable since they force the user to abandon the range top, the most commonly used cooking area in the kitchen. Thus, interface adapters have become popular.

The interface adapters manufactured to date have been rings or collars which are adapted to fit on the range element surface to provide a circular ring upper surface into which the wok bottom nests in a fairly stable fashion. Their lack of stability is a major disadvantage to prior art interface adapters.

Electrical range elements are typically spiral elements with spaces between different portions of the element. In this manner, the bottom surface of the adapter ring will typically rest partially on the element and partially on the spans between portions of the element. Since the shape and size of the electrical elements varies drastically from stove to stove, this can often result in an unstable circumstance. Instability can be a great disadvantage since spillage of cooking oil can lead to kitchen fires and severe burns to the user.

The problem is even more notable in gas ranges which typically have only an open latticework frame to support the cooking vessel with wide spaces between the various elements of the frame. There is a greater danger of instability of the adapter rings on this sort of latticework than even on the electrical elements.

Another disadvantage of prior art adapter rings or collars is that the heat is delivered to the wok in an uneven fashion. Thermal energy is delivered directly by conduction to the ring portion of the wok where the top of the adapter ring and the wok directly interface. However, the remaining portions of the wok must either be heated by radiant energy or by indirect conduction. Consequently, a hot ring area may develop partway up the sides of the wok, particularly if the wok is constructed of less than optimal material. This provides for uneven cooking and does not provide the maximum heat to the very bottom of the wok where most of the actual cooking takes place.

In summary, a regular home stovetop gas jet burner normally spreads flames outwardly away from the center to cover a large area on a flat pan, which is not effective for a wok which needs a very hot flame in the bottom center of the wok, and ordinary home stoves are unsatisfactory for supporting spherical bottoms of Asian wok cooking vessels.

While a number of prior art wok supports have been attempted to be used with gas burners on stove tops (as well as some for use with electric coils) and a number of rings of various types for focusing flames of stovetop gas burners, none of the prior art patents provide a ring for focusing gas jet stovetop burners in combination with a universal wok support to fit a wide variety of stovetop grates and suspend a wok an effective distance above the gas jet to receive the full effect of the focused gas jet on the bottom center of the wok.

U.S. Pat. No. 5,775,316, issued Jul. 7, 1998 to Jones, describes a cooking range with interchangeable grate and wok ring mounted thereon. The range supports the wok ring and the grate over a gas fired burner element. The grate and the wok ring include a support plate which selectively engages the cooking range in a preferred orientation. The wok ring includes a preferred configuration of the support ring.

U.S. Pat. No. 5,345,062, issued Sep. 6, 1994 to Maudal, discloses a support stand which adapts an Asian WOK to a Western kitchen range. The stand provides an upper ring to receive a round bottomed WOK; the ring has sufficient diameter to accommodate the WOK securely in the stand. The base of the stand adapts to prior art drip pans placed in heating wells, where the well has gas or electrical heating elements located according to the type of range, and thus anchors the stand to the kitchen range top. A second concept modifies existing drip pans to provide both the functions of drip pan and support stand in a single, combined support stand. This stand replaces existing stands and drip pans and anchors the WOK to the kitchen range top. A third concept converts a prior WOK fire ring into a trivet allowing use of the WOK at a dinner table.

U.S. Pat. No. 6,718,967, issued Apr. 13, 2004 to Luther, claims a wok support for use in a wok range which incorporates a refractory insulating material into its structure. The wok support includes a tubular support structure having internal space in its wall. The refractory insulating material is disposed in the internal space.

U.S. Pat. No. 5,315,983, issued May 31, 1994 to Law, indicates a wok support ring comprising a two-piece support ring structure for supporting a wok cooking vessel on top of a burner cylinder of a cooking range. The structure features two components: a top ring of a substantially circular shape upon which sits a wok; and a base ring having a substantially circular shape that removably rests on the burner cylinder. The top ring removably rests on the base ring. The base ring itself comprises a first ring and a first mating means disposed on top of the first ring for removably coupling the base ring to the top ring. The top ring comprises a second ring upon which sits the wok and a second mating means projecting from the bottom of the second ring for removably coupling the top ring to the first mating means. The base ring further comprises a third mating means for removably coupling the base ring to the burner cylinder.

U.S. Patent Application #20020162923, published Nov. 7, 2002 by Geddes, indicates a support for a cooking vessel which comprises a ring having an upper portion for supporting the cooking vessel, and a lower portion formed with L-shaped slots for bayonet-type engagement with tines of a pan support grid of a conventional gas hob.

U.S. Pat. No. 4,607,613, issued Aug. 26, 1986 to Toldi, puts forth a wok adapter made from a thermally conductive material and has an exterior shape substantially in the nature of a frustum of a cone. The upper surface of the adapter is concave in the shape of a sector of a sphere such that a traditional wok will nest therein with approximately equal contact over the entire interface therebetween. The bottom surface of the adapter is substantially flat for maintaining a solid stable perch on either electrical stove elements or gas range lattice support structures. The bottom of the adapter may be provided with anti-slip protrusions which prevent the adapter from sliding on the top of the range element. The side of the adapter is angled outward in a conical fashion such that the heat generated by a smaller area of element at the bottom surface of the adapter may be delivered to a greater area of the wok surface for maximum usable cooking area. The adapter can be provided with a handle attachment detent such that a detachable handle may be attached thereto for transporting the adapter while it is still hot.

U.S. Pat. No. 6,093,018, issued Jul. 25, 2000 to Avshalumov, shows a gas burner comprising in combination means for controlled feeding and subsequent admixing of a secondary air directly to the base of the flame in a form of a cap coaxially surrounding a burner head of the gas burner comprising a lateral apertures for issuing combustible air-gas mixture to form a flame. The through lateral openings of the predetermined size having the total cross section greater than the total cross-section of the apertures of burner head are performed on the side wall surface of the cap. During the operation of the gas burner the exact measured amount of the secondary air is admixed directly to the base of the flame, thereby highly efficient and complete combustion process characterized by high-elevated temperature is achieved.

U.S. Pat. No. 698,507, issued Apr. 29, 1902 to Jeha, discloses a gas saving appliance for concentration heat to the bottom of a cooking utensil. The appliance comprises an annular ring body with a flanged upper edge that leaves a heat concentrating opening at the top. The ring body is provided with ventilation holes.

U.S. Pat. No. 834,733, issued Oct. 30, 1906 to Jeha, puts forth a gas saving appliance which comprises an inner cylindrical perforated drum which direct the gas heat upwardly and an outer inwardly curved and perforated drum with an opening at its top which allows heat to contact the bottom of a cooking vessel.

U.S. Pat. No. 5,791,333, issued Aug. 11, 1998 to Bennett, claims a burner system for a gas range which includes an annular metal pan through which the gas flame selectively projects, and an annular grill or grate overlying the pan on which the bottom of a cooking utensil is selectively supported. In addition, the inventive system includes an element for directing the gas flame inwardly and upwardly towards the bottom of the utensil, as well as for substantially reducing heat loss generated by flame operation.

U.S. Pat. No. 1,346,761, issued Jul. 13, 1920 to Moore, claims a gas burner with a frusto-conical cover for directing the flames through the center upper orifice. The cover has air inlet notches at its base and a plurality lateral flame emitting orifices in the side wall.

U.S. Pat. No. 1,414,146, issued Apr. 25, 1922 to Moellendick, describes a gas burner attachment for retaining and directing heat to the bottom of a pan. The device is made of a strip of sheet metal with notches at the bottom edge thereof for the purpose of receiving the arms of a gas burner.

U.S. Pat. No. 1,546,919, issued Jul. 21, 1925 to Dore, puts forth a heat saving device for a gas burner. The device comprises an annular upwardly converging wall or deflector forming a converging flame directing passage communicating with an unobstructed upper central flame discharge opening. The deflector is supported on the burner by four internally located downwardly converging support arms.

U.S. Pat. No. 1,592,729, issued Jul. 13, 1926 to Feist, concerns an adjustable economizer and adapter for burners having a annular wall with an upwardly converged top flange for the purpose of focusing the heat to the bottom of the cooking vessel.

U.S. Pat. No. 1,692,000, issued Nov. 20, 1928 to Steffens, illustrates a mantle which sits upon gas burners. The mantle comprises an inverted frusto-conical, the lower wider opening of which sits on top of the burner and directs the heat up through the upper narrower opening. A cylindrical portion is affixed the upper narrower opening to further direct the heat through a stove top grate.

U.S. Pat. No. 1,772,407, issued Aug. 5, 1930 to Wilhelm, shows a gas burner attachment which comprises an auxiliary top having an elevated plateau with a gently sloping downward flange provided with a plurality of circumferentially arranged air vent opening and a centrally located depressed portion to ensure complete combustion.

U.S. Pat. No. 1,072,115, issued Sep. 2, 1913 to Harmon, is for a gas stove having a housing positioned over the burner to confine the flame against the bottom of a cooking vessel, said housing having notches in its upper edge for receiving the utensil holding fingers of the stove top.

U.S. Pat. No. D250,931, issued Jan. 30, 1979 to Pierce, provides the ornamental design for a gas saving grate.

U.S. Pat. No. D364,534, issued Nov. 28, 1995 to Brown, puts forth the ornamental design for an adapter for elevating an accessory above a stove heating element.

U.S. Pat. No. D545,124, issued Jun. 26, 2007 to Hawkins, is for the ornamental design for a wok ring.

U.S. Pat. No. 4,006,676, issued Feb. 8, 1977 to Adamis, discloses a crepe-making pan and support. The crepe pan is such that it is adapted to distribute the batter over the flat exposed bottom surface of the bottom of the pan; a base locates and supports the pan in position and is so dimensioned as to surround the flame and distribute the heat evenly over the flat bottom of the pan; the weight distribution of the pan and its handle being such that the pan will be firmly seated around a suitable flange on a shoulder adjacent the flange of the substantially cylindrical base.

U.S. Pat. No. 4,448,186, issued May 15, 1984 to Smith, concerns a device for concentrating heat from a flame of a gas stove in combination with a cooking utensil includes a first collar rigidly attached to the cooking utensil and mating with a second collar attached to a grid of the stove. The collars may have several peripherally disposed vents. The second collar can be rotated to align the vents and control the venting of the flame of the stove.

U.S. Pat. No. 881,199, issued Mar. 10, 1908 to Palmer, illustrates a stove ring made from a band of light sheet metal. The sheet metal band has vent openings.

U.S. Pat. No. 983,413, issued Feb. 7, 1911 to Swafford, concerns a heat concentrating ring for gas or vapor stoves or ranges of which the height and diameter are adjustable. The device comprises two ring form sections, one having horizontally elongated slots and the other having vertically elongated slots and fasteners, such as bolts passing through the slots. One of the ring forms has additional air supply openings.

U.S. Pat. No. 1,131,226, issued Mar. 9, 1915 to Frank, provides a conico-cylindrical heating device which has an upper opening that supports a cooking vessel and a wider lower opening that sits upon a stove top grate. The device has a support made from intersecting grate bars which extend across the lower opening. Slots in the ends of the grate bars interlock with the outer face of the lower receiver opening.

U.S. Pat. No. 1,142,603, issued Jun. 8, 1915 to Moellendick, shows an ornate gas stove attachment which confines and directs the heat from a burner to the bottom of a pot or pan. The body member has a lower end which extends over a burner. Within the body member is an inner inwardly curved deflector for directing the heat, the upper opening of which has a series of radially spaced projections that disperse the heat evenly on the bottom of the pan.

U.S. Pat. No. 1,431,696, issued Oct. 10, 1922 to Shankland, discloses a ring-type support for cooking utensils made of a hollow body of sheet metal having annular vertical wall provided with a plurality of perforations. The cooking utensil is supported in an upper opening having a series of stepped diameters in the opening for supporting different sized pans.

U.S. Pat. No. 1,471,788, issued Oct. 23, 1923 to Gardner, indicates an adjustable short ring or funnel-type gas burner attachment which confines, condenses and directs the heat to the article being heated. The device is provided with air holes near the lower edge for providing ventilation and assisting in combustion.

U.S. Pat. No. 1,881,606, issued Oct. 11, 1932 to Humphreville, provides a heat conserver sleeve which surrounds a gas burner and directs the heat upwardly to the bottom of a cooking vessel. The sleeve is provided with a plurality of air vents for admission of secondary air to assist in combustion.

U.S. Pat. No. 4,337,752, issued Jul. 6, 1982 to Leounes, describes a heat retaining collar device for reducing lateral heat dissipation from range top heating elements during cooking operations. An integrally-formed annular collar means of generally frusto-conical configuration is adapted to rest atop a range, in surrounding relation to a heating element disposed on said range top. A generally toroidally-shaped pocket of heated air surrounds an item of cookware adjacent its lower portion when such cookware is slideably received within the opening of the collar-like device surrounding the element. A first alternative embodiment has a hollow collar so that a dead air space interiorly of the collar-like device provides an additional thermal barrier. A second alternative embodiment provides a plurality of successively smaller nesting collars to accommodate cookware of differing sizes.

What is needed is a combination fire ring with walls that curve in at the top to focus the flame of a standard stovetop gas jet into an intense jet of flame focused upwardly and inwardly to hit the bottom center of the wok and a wok support which mounts on and straddles the radial cooking vessel support members of the stovetop grate to position the wok over the gas jet to receive the jet of flame on the bottom center of the wok.

BRIEF SUMMARY OF THE INVENTION

An object of the present invention is to provide a combination fire ring with walls that curve in at the top to focus the flame of a standard stovetop gas jet into an intense jet of flame focused upwardly and inwardly to hit the bottom center of the wok and a wok support which mounts on and straddles the radial cooking vessel support members of the stovetop grate to stabilize the wok for intensive stirring and to position the wok over the gas jet to receive the jet of flame on the bottom center of the wok.

In brief, a combination flame focusing ring and adaptable wok support can be used on a variety of stovetop gas burners. The flame focusing ring focuses fire inwardly and upwardly from the stovetop gas jet into a hot jet of flame focused on the bottom center of the wok. The fire ring has vent openings all around the bottom to let in air to feed flames to force them upwardly and inwardly to intensify the flames. The wok support has break-away tabs all around the bottom edge so that a tab can be broken off to match each of the radial support members of the stove grate so that the wok support is removably secured on the top of the grate by each notch straddling one of the grate arms. The wok support has air vent openings around the sides.

The fire ring of the invention has walls that curve in at the top to focus the flame into an intense jet of flame hitting the bottom center of the wok, which is required for proper stir fry cooking in a wok to seal in the moisture of the food by searing the outside of the food with the intense jet of flame essentially transforming the substantially horizontally directed flame from the side jets of the stovetop gas jet into a substantially vertically focused jet flame to heat the bottom center of the wok.

The primary advantage of the present invention is that it provides a focused flame on the bottom center of the wok to deliver the high heat temperature necessary for flash-flame cooking.

Another advantage of the present invention is that it increases overall heat output by 50% due to the intense focused air infused jet flame without using additional gas.

Another advantage of the present invention is that it provides an improved wok support ring having snap off slot tabs which straddles cooking vessel support members on all different sizes and types of stove grates for stability and proper height of the wok above the flame jet.

Another advantage of the present invention is that it provides an improved wok support ring with roller bearings to cradle the wok to allow easy manipulation of the wok.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
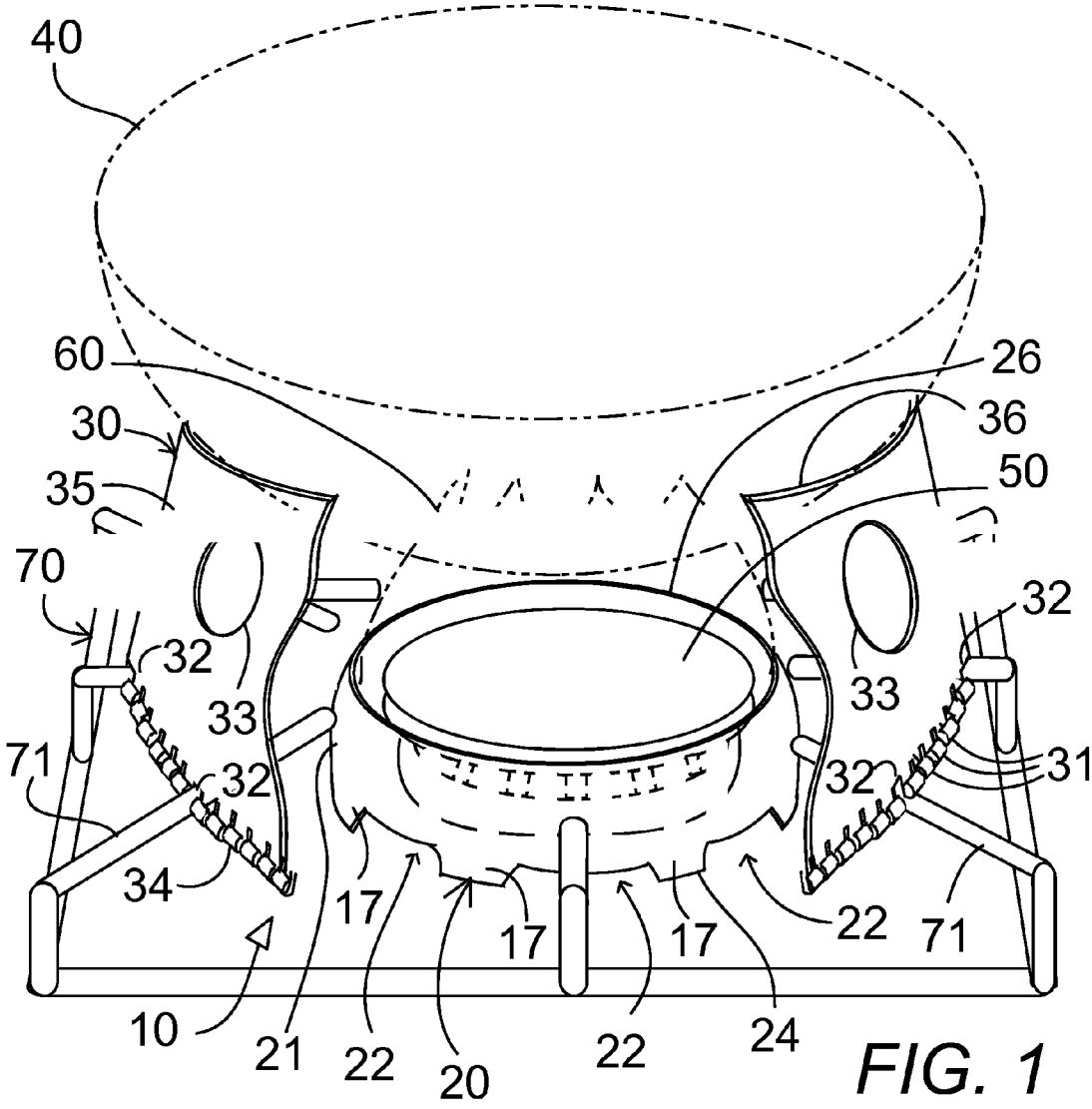
FIG. 1 is a broken perspective view of the combination universally adaptable wok support and flame focusing ring of the present invention showing the ring around the gas jet and the wok support straddling the radial cooking support members of the stovetop grate with the focused jet of flame hitting the bottom center of the wok held in the optimum cooking position by the wok support.

In FIGS. 1-7, a stovetop wok cooking system 10 comprising in combination a flame focusing ring 20 around the gas burner 50 to focus the flame 60 inwardly and upwardly in a hot jet of flame and a wok support 30 to support a wok 40 at a desired distance centered over the hot focused jet of flame.

Figure 2:
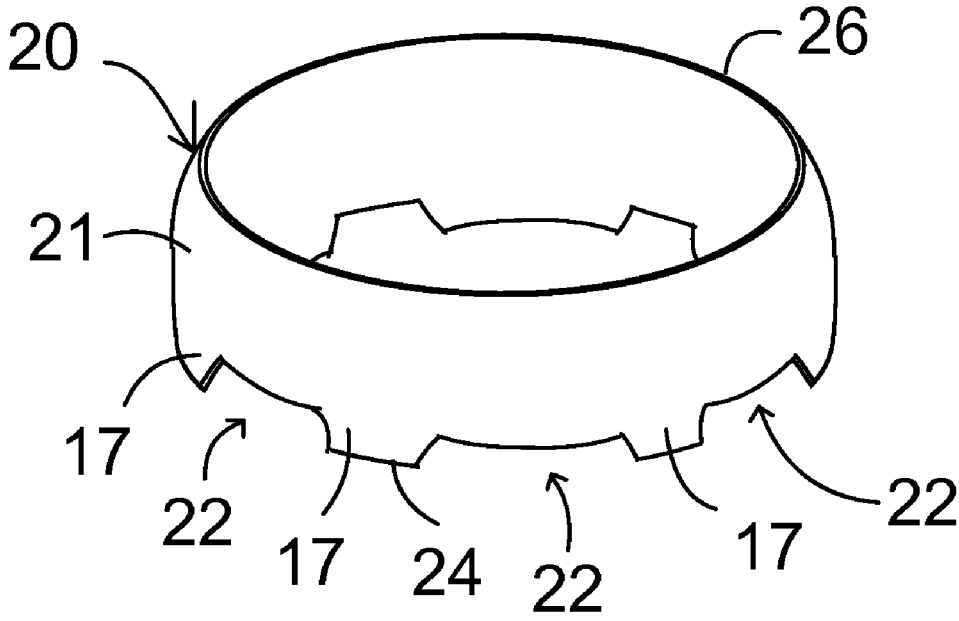
FIG. 2 is a perspective view of the flame focusing ring of FIG. 1.
Figure 3:
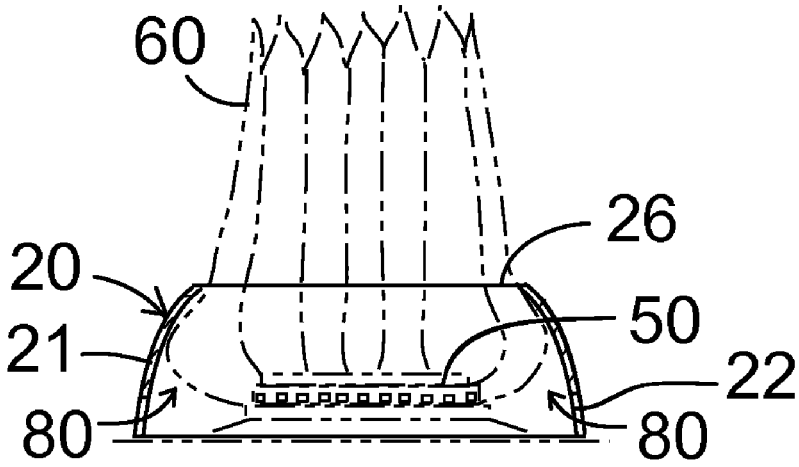
FIG. 3 is a side elevational view of the flame focusing ring of FIG. 1 with the flame focusing ring positioned around a gas jet, showing the upwardly and inwardly focused gas jet flame produced.
Figure 4:
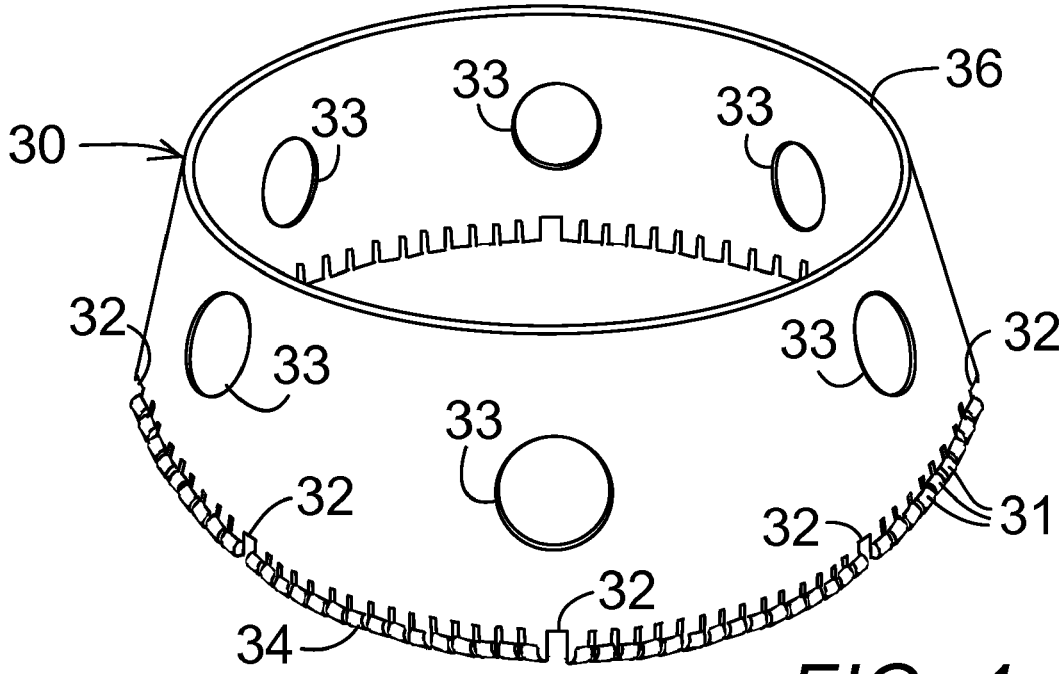
FIG. 4 is a perspective view of the wok support of FIG. 1.

In FIGS. 1-3, a flame focusing ring 20 rests on the stovetop surface under the stovetop grate 70 immediately surrounding the gas jet 50 in close proximity to the gas jet. The flame focusing ring 20 comprises an annular ring of fire proof material having a circular bottom ring opening 24 encircling the gas jet spaced apart from the gas jet in close proximity to the gas jet, an annular inwardly concave curved wall 21 extending upwardly from the bottom ring opening 24 to a top ring opening 26 smaller in diameter than the gas jet so that the flame focusing ring focuses fire from the gas jet upwardly and inwardly into a hot jet of flame 60 contacting a bottom center portion of the wok 40. The flame focusing ring has air vent openings around a bottom perimeter to admit air 80, shown in FIG. 3, therethrough to force the flame from the gas jet 50 upwardly and inwardly. The air vent openings in the fire focusing ring 20 comprise a series of spaced vent holes 22 cut out of the bottom edge of the fire focusing ring leaving a support leg 27 extending downwardly between each adjacent pair of vent holes 22. The top lip 26 of the flame focusing ring 20 angles inwardly and combines with an upward pressure from air 80 admitted into the flame focusing ring from the air vent openings 22 to contour the gas flame and to focus the hot jet of flame 60 upwardly and inwardly toward the bottom center of the wok 40.

In FIGS. 1 and 4-7, the wok support 30 comprises a truncated conical shaped fireproof structure 35 having a series of spaced air vent openings 33 therethrough and having a circular bottom support opening 34 configured with means to rest on and straddle a radial array of cooking vessel support members 71 of a stovetop grate 70 above a gas jet 50 on a stove top and a circular top support opening 36 smaller in diameter than the bottom support opening. The top support opening 36 is configured to support a wok 40 cooking vessel resting on the top support opening with a bottom of the wok cooking vessel resting within the wok support extending down into the wok support above the gas jet 50. The means to rest on and straddle the radial array of cooking vessel support members 71 of the stovetop grate 70 above the gas jet 50 on the stove top comprises a continual array of break-away tabs 31 around the entire edge of the bottom support opening 34, each of the tabs 31 equal in width to a radial cookware support member 71 of the stovetop grate 70 so that a series of spaced tabs around the bottom support opening can be broken off to create a series of bottom notches 32 in the bottom support opening 34 to match each of the radial cookware support members 71 of the stovetop grate so that the wok support is removably secured on the top of any of a wide range of sizes of stovetop grates by each notch 32 straddling one of the radial cookware support members 71 of any of the stovetop grates 70, as shown in FIG. 1.

Figure 5:
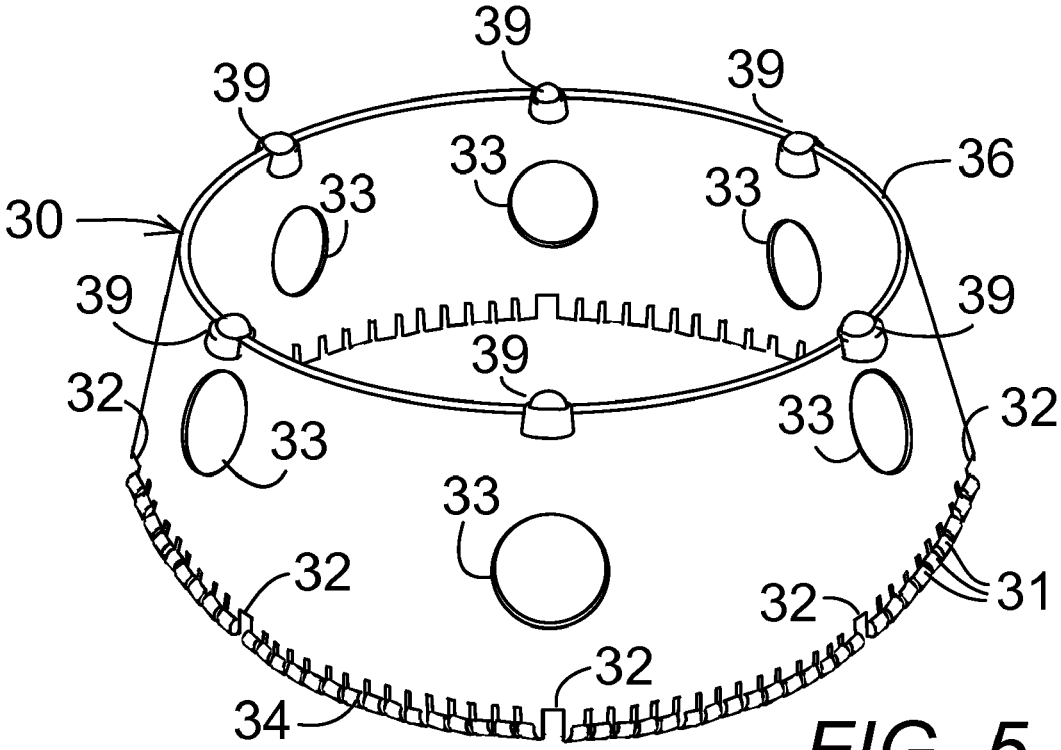
FIG. 5 is a perspective view of the wok support of FIG. 1 with roller bearings mounted in a spaced array around the top support opening to allow easy manipulation of the wok on the support ring.
Figure 6:
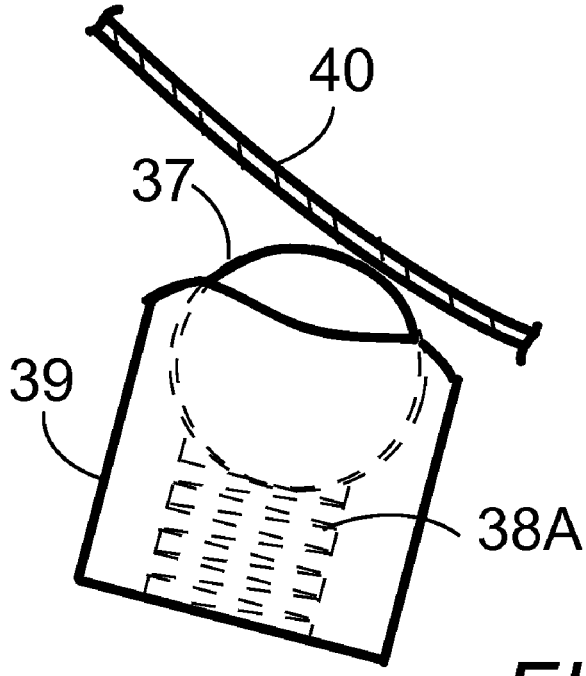
FIG. 6 is a side elevational view of a ball bearing of FIG. 5 showing the wok resting on the ball bearing and an internal coil spring supporting the roller ball in the ball bearing casing.
Figure 7:
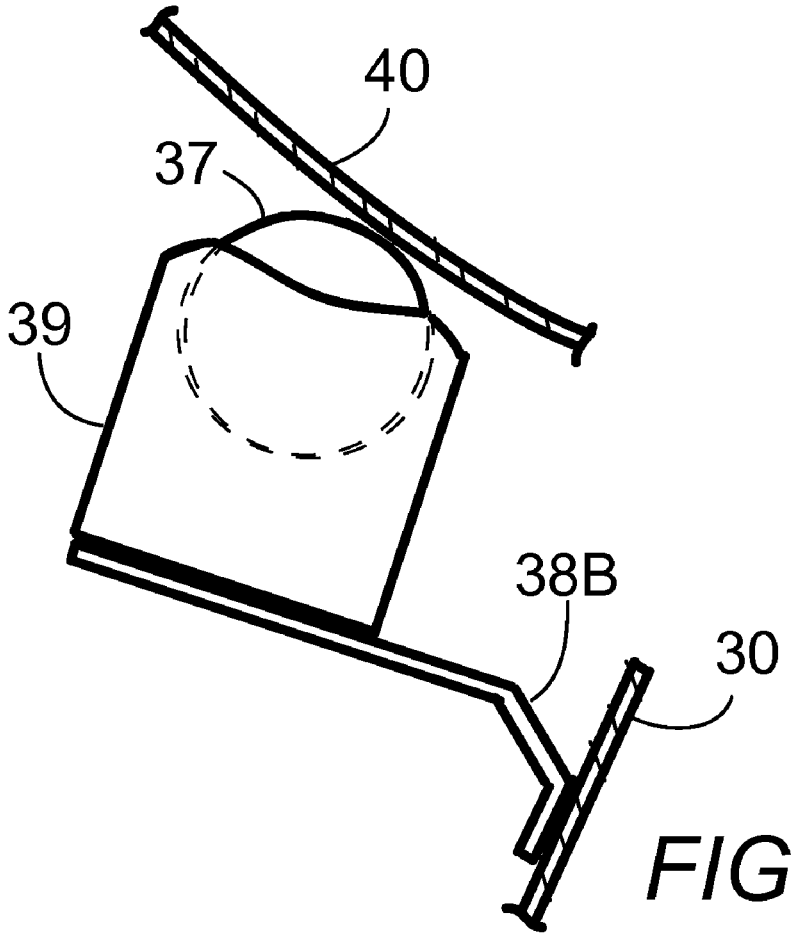
FIG. 7 is a side elevational view of a ball bearing of FIG. 5 showing the ball bearing attached to the wok support by a leaf spring and the wok resting on the ball bearing.

In FIGS. 5-7, a plurality of ball bearings 39 or roller bearings may be mounted in a spaced array around the top support opening 36 to allow easy manipulation of the wok 40 resting on the plurality of roller bearings.

In FIGS. 5 and 6 each of the ball bearings comprises a casing 39 housing a coil spring 38A supporting a roller ball 37 so that the roller ball flexes to allow vertical flexing of the wok on the roller balls.

In FIG. 7, each of the ball bearings 39 is attached to the wok support by a leaf spring 38B so that the ball bearing flexes to allow vertical flexing of the wok on the ball bearings.

The flame focusing ring 20 could be fabricated from steel, cast metal, thermal ceramic, or other flame and heat resistant material.

In use, the stovetop grate 70 is put aside, the flame focusing ring 20 is placed on the stove top surface evenly surrounding the gas burner 50 on the stovetop, and the stovetop grate is repositioned over the gas burner 50 and the flame focusing ring 20. A series of spaced tabs 31 around the bottom support opening can be broken off to create a series of bottom notches 32 in the bottom support opening 34 to match each of the radial cookware support members 71 of the stovetop grate and that the wok support 30 is mounted on the stovetop grate 70 with each of the notches 32 straddling one of the cooking vessel support members 71 for a stable support. The wok 40 is placed on the wok support 30 and the gas burner 50 ignited to create the hot jet of flame 60 which is focused on the bottom center of the wok. Instead of the flames flaring out horizontally to spread over a flat bottom of a cooking vessel normally placed on the stovetop grate, the flame is focused inwardly and upwardly in at least a 90 degree change in direction of the flame into a focused jet of flame 60 focused on the bottom center of the wok 40.

The focused jet of flame 60 rises up past the stove grate unimpeded as a focused flame. As the focused flame rises its optimum temperature at a distance of approximately two inches from the top edge of flame focusing ring 20 to the center bottom of the wok 40 cooking vessel. Maximum heat is achieved and minimum heat is lost. Heat normally lost through an unfocused stove burner is utilized effectively to increase BTU's by no less than 50%.

The plurality of vents 22 located around the base of the ring walls facilitates the free-flow of combustion gases 80 as it creates a vacuum of low pressure in the ring chamber and to prevent flame constriction and contributes towards efficient combustion.

It is understood that the preceding description is given merely by way of illustration and not in limitation of the invention and that various modifications may be made thereto without departing from the spirit of the invention as claimed.

What is claimed is:

1. A stovetop wok cooking system comprising in combination:

a flame focusing ring resting on the stovetop surface under the stovetop grate immediately surrounding the gas jet in close proximity to the gas jet, the flame focusing ring comprising an annular ring of fire proof material having a circular bottom ring opening encircling the gas jet spaced apart from the gas jet in close proximity to the gas jet, an annular inwardly concave curved wall extending upwardly from the bottom ring opening to a top ring opening smaller in diameter than the gas jet so that the flame focusing ring focuses fire from the gas jet upwardly and inwardly into a hot jet of flame contacting a bottom center portion of a wok, the flame focusing ring having air vent openings around a bottom perimeter to admit air therethrough to force the flame from the gas jet upwardly and inwardly; and a wok support comprising a truncated conical shaped fireproof structure having a series of spaced air vent openings therethrough and having a circular bottom support opening configured with means to rest on and straddle a radial array of cooking vessel support members on a variety of stovetop grates above a gas jet on a stove top, the means to rest on and straddle the radial array of cooking vessel support members of the stovetop grate above the gas jet on the stove top comprising a continual array of break-away tabs around the entire edge of the bottom support opening, each of the tabs equal in width to a radial cookware support member of the stovetop grate so that a series of spaced tabs around the bottom support opening can be broken off to create a series of bottom notches in the bottom support opening to match each of the radial cookware support members so that the wok support is removably secured on the top of any of a wide range of sizes of stovetop grates by each notch straddling one of the radial cookware support members of any of the stovetop grates, and a circular top support opening smaller in diameter than the bottom support opening, the top support opening configured to support a wok cooking vessel resting on the top support opening with a bottom of the wok cooking vessel resting within the wok support extending down into the wok support above the gas jet so that the hot jet of flame contacts the bottom center portion of the wok.

2. The system of claim 1 wherein a top lip of the flame focusing ring angles inwardly and combines with an upward pressure from air admitted into the flame focusing ring from the air vent openings to contour the gas flame and to focus the hot jet of flame upwardly and inwardly toward the bottom center of the wok.

3. The system of claim 1 wherein the air vent openings in the flame-focusing ring comprise a series of spaced vent holes cut out of the bottom edge of the flame-focusing ring leaving a support leg extending downwardly between each adjacent pair of vent holes.

4. The system of claim 1 further comprising a plurality of spaced ball bearings attached around the top support opening of the wok support so that the wok rests on the ball bearings to allow manipulation of the wok.

5. The system of claim 4 wherein each of the ball bearings comprises a casing housing a coil spring supporting a roller ball so that the roller ball flexes to allow vertical flexing of the wok on the roller balls.

6. The system of claim 4 wherein each of the ball bearings is attached to the wok support by a leaf spring so that the ball bearing flexes to allow vertical flexing of the wok on the ball bearings.

7. A stovetop wok cooking system comprising in combination:

a flame focusing ring resting on the stovetop surface under the stovetop grate immediately surrounding the gas jet in close proximity to the gas jet, the flame focusing ring comprising an annular ring of fire proof material having a circular bottom ring opening encircling the gas jet spaced apart from the gas jet in close proximity to the gas jet, an annular inwardly concave curved wall extending upwardly from the bottom ring opening to a top ring opening smaller in diameter than the gas jet so that the flame focusing ring focuses fire from the gas jet upwardly and inwardly into a hot jet of flame contacting a bottom center portion of a wok, the flame focusing ring having air vent openings around a bottom perimeter to admit air therethrough to force the flame from the gas jet upwardly and inwardly; and a wok support comprising a truncated conical shaped fireproof structure having a series of spaced air vent openings therethrough and having a circular bottom support opening configured with means to rest on and straddle a radial array of cooking vessel support members on a variety of stovetop grates above a gas jet on a stove top and a circular top support opening smaller in diameter than the bottom support opening and a plurality of spaced ball bearings attached around the top support opening of the wok support so that the wok rests on the ball bearings to allow manipulation of the wok, the top support opening configured to support a wok cooking vessel resting on the top support opening with a bottom of the wok cooking vessel resting within the wok support extending down into the wok support above the gas jet so that the hot jet of flame contacts the bottom center portion of the wok.

8. The system of claim 7 wherein each of the ball bearings comprises a casing housing a coil spring supporting a roller ball so that the roller ball flexes to allow vertical flexing of the wok on the roller balls.

9. The system of claim 7 wherein each of the ball bearings is attached to the wok support by a leaf spring so that the ball bearing flexes to allow vertical flexing of the wok on the ball bearings.

* * * * *